United States Patent [19]

Kurita et al.

[11] 4,428,792

[45] Jan. 31, 1984

[54] METHOD OF FORMING A STRUCTURAL COLUMN

[75] Inventors: Yukio Kurita, Neyagawashi; Satoshi Nakagawa, Hirakatashi, both of Japan

[73] Assignee: Matsushita Electric Works, Ltd., Osaka, Japan

[21] Appl. No.: 371,726

[22] Filed: Apr. 26, 1982

Related U.S. Application Data

[62] Division of Ser. No. 164,324, Jun. 30, 1980, Pat. No. 4,387,546.

[30] Foreign Application Priority Data

Jan. 29, 1980 [JP] Japan ..... 55-009146

[51] Int. Cl.[3] ..... B32B 31/18; B32B 31/20

[52] U.S. Cl. ..... 156/196; 52/731; 156/220; 156/222; 156/223; 156/228; 156/245; 156/258; 156/264; 156/304.2

[58] Field of Search ..... 156/196, 212, 217, 218, 156/220, 222, 223, 228, 245, 258, 264, 304.1, 304.2, 304.5; 52/731, 746

[56] References Cited

U.S. PATENT DOCUMENTS

| | | | |
|---|---|---|---|
| 3,086 | 8/1868 | Mayo . | |
| 395,448 | 1/1889 | Markle . | |
| 1,293,208 | 2/1919 | Ryan . | |
| 1,472,897 | 11/1923 | Anderson . | |
| 1,946,694 | 2/1934 | Hunter | 52/731 |
| 2,245,170 | 6/1941 | Ende et al. | 156/222 |
| 2,824,342 | 2/1958 | Hoyle, Jr. . | |
| 2,834,073 | 5/1958 | Hoyle, Jr. . | |
| 3,050,161 | 8/1962 | Shlager | 52/731 |
| 3,277,938 | 10/1966 | Allan | 156/222 |
| 3,312,582 | 4/1967 | Allan et al. | 156/222 |
| 3,615,982 | 10/1971 | Bandremer et al. | 156/212 |
| 3,963,546 | 6/1976 | Roberti | 156/69 |

OTHER PUBLICATIONS

Exhibit 1-a figure from Japanese Patent Publication No. SHOWA 43 (1968)-3757.

*Primary Examiner*—Caleb Weston

*Attorney, Agent, or Firm*—John O. Graybeal

[57] ABSTRACT

A method of forming a structural column wherein a plurality of formed inner and outer column layer halves are integrally constructed from flat sheets of wooden laminate simultaneously bonded together and molded into a triangularly shaped wave pattern.

11 Claims, 14 Drawing Figures

METHOD OF FORMING A STRUCTURAL COLUMN

This is a division of application Ser. No. 164,324, filed June 30, 1980, now U.S. Pat. No. 4,387,546.

DESCRIPTION

1. Technical Field

The present invention relates to wooden structural components, and in particular, to a new structural column member constructed of very thin strips of wooden material laminated together and molded into the shape of a column.

2. Background Art

In the past, structural columns have been constructed from various types of materials integrally or otherwise combined in various ways. For example, one type of known structural column includes a solid central wooden core of square cross section having each of its four surfaces coated with a preservative compound and then overlaid with a flat length of board. The boards are attached to the core with nails. Additional layers of wooden boards are utilized to increase the width of the column, with the boards of each layer being correspondingly wider to cover the entire underlying surface. Because each of the layers is composed of a plurality of individual flat members, rather than of integral construction, the boards of each layer can shift or move relative to each other when loaded, eventually causing the column to buckle if sufficiently stressed. Consequently, a column formed in this particular manner is not capable of carrying as large a compression load as a column designed in a more rigid manner, for instance, by forming the sides of each layer from two angle-shaped components securely bonded together along their free longitudinal edge portions to form a unitary, hollow structure. An example of a column formed with layers of flat boards encasing a central core in the manner described above is disclosed by Markle, U.S. Pat. No. 395,448.

Another known type of structural column is composed of thin layers of wooden laminate bonded together and formed into right-angle shaped members. Two of the members are disposed so that the edge of one member abuts against the adjacent inside wall of the other member to form a hollow, generally square-shaped cross section. This construction has the disadvantage of leaving exposed edges which seriously detract from the appearance of the column. Also, all of the laminations at one edge of each angle member abut against a single, inside lamination of the opposite member, which joint design is weaker than if each lamination of each angle member is bonded with a corresponding lamination of the opposite angle member. An example of this particular construction is disclosed by Japanese Patent Publication No. Showa 43(1968)-3757.

A further type of known structural column is formed by cementing together thin sheets of wood veneer to form various hollow, cross-sectional shapes, such as round, oval or rectangular. The individual sheets of veneer are oriented relative to each other so the direction of their grains is not aligned, to thereby minimize checking or splitting of the layers. Examples of structural members constructed in this particular manner are disclosed in Mayo, U.S. Pat. No. 3,086.

Another known type of structural column is constructed from two lengths of steel angle members welded together along their free edges to form a square cross section. The hollow interior of the column is filled with concrete to improve the ability of the column to carry compression loads without buckling. However, this particular construction results in a column which is extremely heavy in comparison with a similarly sized column formed from wood, thereby making it extremely difficult to handle and expensive to transport. Moreover, columns fabricated from welded steel members are not particularly aesthetically pleasing and thus are overlaid with more decorative materials, such as gypsum board or wood veneer. Furthermore, the high cost of steel when added to the expense of welding the two angle members together results in a column member which is too expensive to be used to construct smaller buildings and residential dwellings. An example of a column member utilizing this particular design is disclosed by U.S. Pat. No. 3,050,161 to Shlager.

An additional type of known column member is composed of two right angle-shaped, cross-sectional halves formed from sheet metal. The longitudinal edges of each sheet metal half are curved to form a quarter round marginal edge portion. The column is assembled by overlapping the corresponding rounded marginal portions of the two angle members to thereby form a square cross section. Thereafter, the marginal edge portions are welded together to form a rigid structure. An example of this particular type of construction is disclosed in Hunter, U.S. Pat. No. 1,946,694. Although sheet metal column members formed in the manner of the Hunter U.S. Pat. No. 1,946,694 might be considered aesthetically pleasing enough to be used in furniture construction or the like, such columns are generally too stark to be used in the interior of dwellings or offices and thus must be covered with wood veneer or other interior building materials. Also, wooden or gypsum walls cannot be nailed directly to the metal columns, but must be fastened thereto by more expensive and more cumbersome to use hardware.

DISCLOSURE OF THE INVENTION

The present invention relates to novel structural columns which, in basic form, are characterized by a composite outer layer of thin wooden laminations formed into a hollow, cross-sectional shape. The hollow cross-sectional shape of the outer layer is composed from two substantially identical pre-fabricated halves each having longitudinal margins defined by a formed shoulder terminating in a diagonally disposed edge. The two outer layer halves are joined together along their edges to define a closed form. The column also includes at least one composite inner layer formed into a hollow, cross-sectional shape corresponding to the cross-sectional shape of the outer layer. The inner layer is sized to fit within, and closely underlie, the outer layer. As with the outer layer, the inner layer is composed of two, substantially identical pre-fabricated halves each having longitudinal margins defined by a formed shoulder terminating in a diagonally disposed edge. The two inner halves are joined together along their edges to define a closed, hollow form.

In the manufacturing process, a plurality of formed inner and outer column layer halves are integrally constructed from flat sheets of wooden laminate simultaneously bonded together and molded into a triangularly shaped wave pattern. The wave pattern in cross section includes crests and valleys interconnected together by diagonal legs. Moreover, each diagonal leg is formed with a double offset bond portion. The crest and valley portions of the formed laminate are severed from each other by cutting through the offset bend portion of each diagonal leg to thereby leave outer and inner layer halves respectively, which can be bonded together in the manner described above.

The hollow interior of the inner layer can be filled with a snugly fitting central core which extends longitudinally through the length of an inner layer and terminates at a location spaced a short distance away from each end of the inner layer to form a cavity or socket within each end portion thereof. The central core is bonded to the inner layer with a suitable adhesive and can be formed from a single length of solid wooden material or from two or more lengths of wooden material bonded together. Alternatively, the central core can be constructed from very thin strips of wooden material laminated together to form a unitary structure.

It is a primary object of the present invention to provide a structural column, and a method of constructing the column, from components of preformed laminated shapes bonded together to form a unitary, preferably hollow, structure capable of safely carrying a much larger load than can be safely carried by a solid wooden column of the same type of material and the same cross-sectional shape and size.

A further object of the present invention is to provide a method of constructing a structural column which can utilize almost all of the wood of a log.

Another object of the present invention is to provide a wooden structural column and a method of manufacturing the column so that it has a pleasing, decorative appearance to thereby enable the column to remain exposed to either the exterior or interior of a dwelling, office, or similar building.

One more object of the present invention is to provide a wooden structural column which can be economically and easily fabricated from identical, individual components bonded together into an integral form.

Yet a further object of the present invention is to provide a method of simultaneously forming a plurality of column components from very thin layers of wooden material bonded together and simultaneously molded into a formed laminate having a desired cross-sectional configuration.

BEST MODE OF CARRYING OUT THE INVENTION

Figure 1:
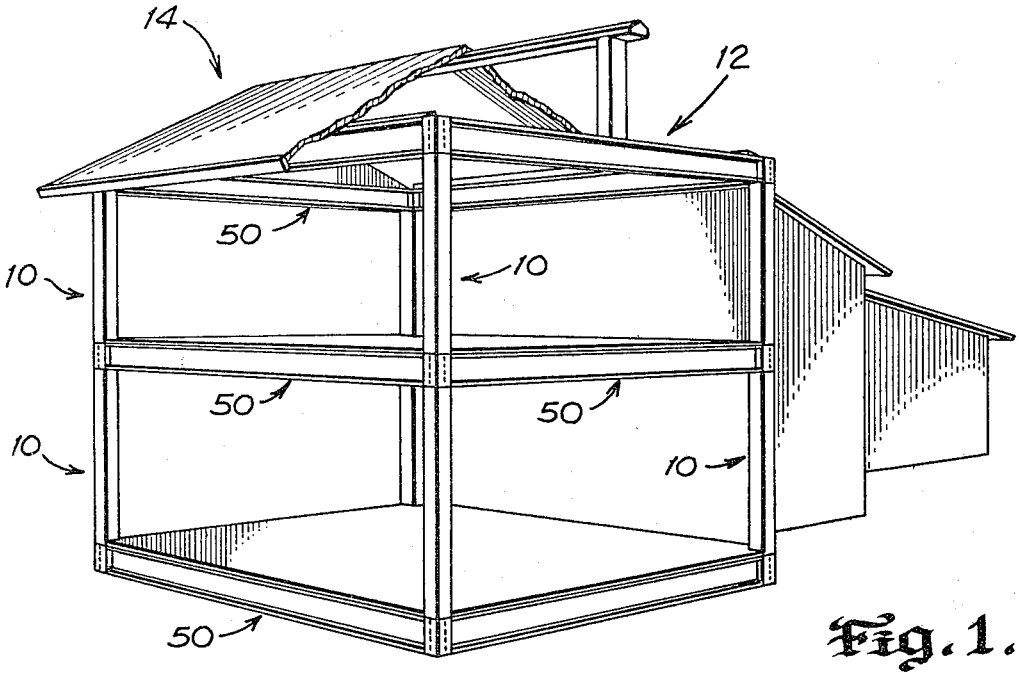
FIG. 1 is a fragmentary, isometric view illustrating an example of a building frame structure assembled with typical structural columns constructed according to the present invention.

Referring initially to FIG. 1, structural columns 10 constructed according to the best mode of the present invention currently known to applicant are utilized in the assembly of a framework 12 for building 14. Additionally, referring to FIGS. 2 and 3, column 10 is illustrated as basically including an elongate, outer layer 16 overlying and bonded to a snugly fitting hollow inner layer 18.

Outer layer 16 is constructed from two substantially identical, preformed, right-angle shaped halves 20 bonded together along their longitudinal margins 22 to form a generally square-shaped cross section. The margins 22 of each halve 20 are defined by rounded shoulders which terminate in diagonally disposed edges 23 that abut against matching edges of the other outer layer half 20 to cooperatively form rounded corners of substantially the same radius as the radius of angle corners 24. By this construction, the edges 23 of halves 20 are not left exposed, thus giving column 10 the pleasing appearance of a solid wooden member. As perhaps best illustrated in FIG. 3, each member 20 is composed of elongate, very thin sheets of wooden material formed and bonded together into an angle shape.

Figure 3:
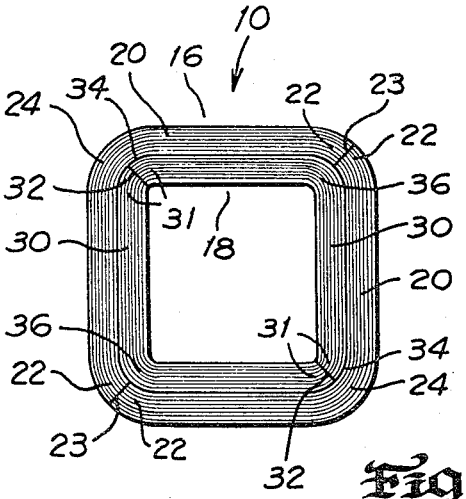
FIG. 3 is a greatly enlarged, transverse, cross-sectional view of the typical embodiment shown in FIG. 2 and taken substantially along lines 3—3 thereof.

Again referring specifically to FIG. 3, inner layer 18 of column 10 is composed of two angle-shaped members 30 bonded together along their longitudinal margins 31 to form a generally square-shaped cross section of a size snugly fitting within the hollow interior of outer layer 16. As with outer layer angle members 20, inner layer members 30 are constructed from very thin sheets of wooden material formed and bonded together into an angle shape. The margins 31 of each member 30 are defined by rounded shoulders which terminate in diagonally disposed edges 32 which abut against matching edges of the other inner layer half 30 to form rounded corners of substantially the same radius as the radius of angle corners 36.

Corners 36 and the corners formed by the intersection of two angle members 30 are all sized to match the curvature of the inside surface of the overlying corners formed by the intersection of the two outer angle members 20 and by outer angle member corners 24, respectively. The correspondence between the corners of the outer and inner layers of column 10 ensures that the layers fit snugly together even at their corners thereby enhancing the structural integrity, and thus the strength, of the column.

Figure 2:
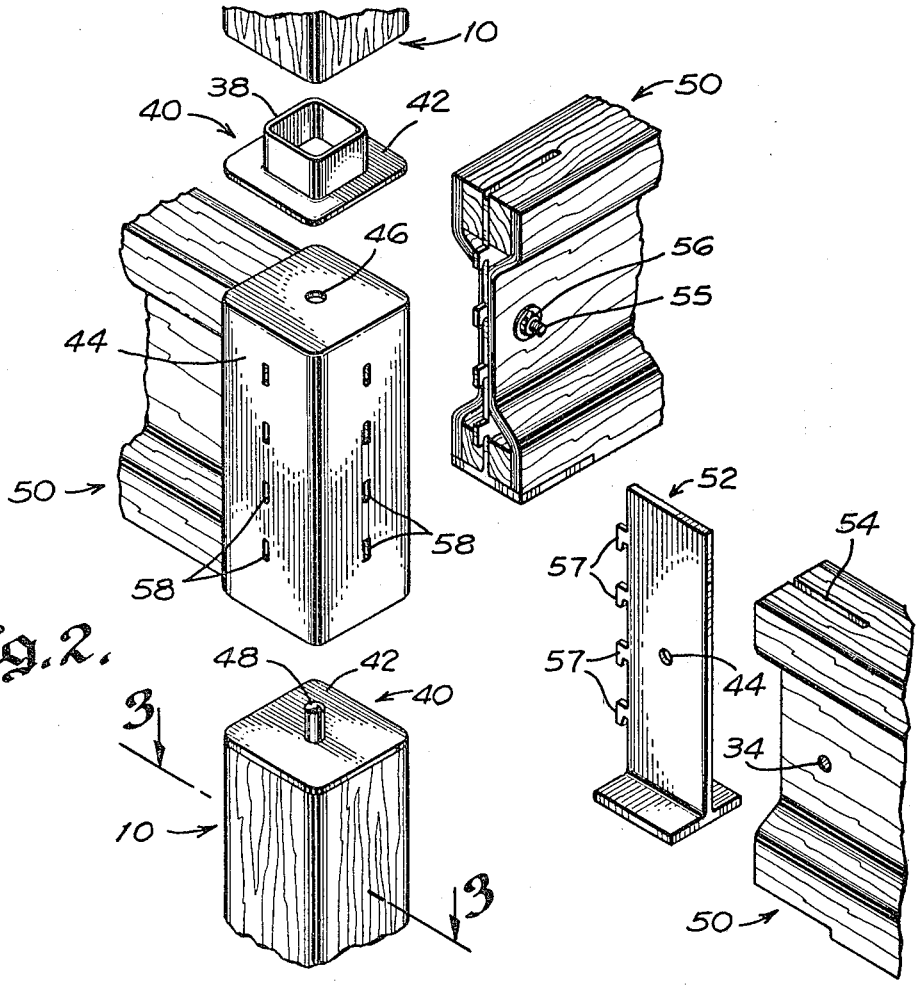
FIG. 2 is an enlarged, isometric partially exploded, fragmentary view illustrating the interrelationship between the typical structural columns of the present invention and the other structural components used in the formation of a building frame structure.

It is to be understood that although a single inner layer 18 is illustrated in FIGS. 2 and 3, column 10 can be constructed from several inner layers nested within each other in a manner similar to the placement of inner layer 18 within outer layer 16. Moreover, it is possible to construct a column, such as column 510 shown in FIG. 12, with a single layer 516, such as outer layer 16 of column 10, shown in FIG. 3. Also, even though column 10 is square in cross section, it can be constructed in other cross-sectional shapes, such as circular, rectangular or hexagonal, without departing from the scope of the present invention.

Although not essential, it is preferred that inner layer 18 is composed of the same number of laminations as outer layer 16. Also, preferably, inner layer 18 is rotatably oriented relative to outer layer 16 so that edges 32 of inner layer 18 are not aligned with edges 23 of outer layer 16, to thereby maximize the strength of and enhance the structural integrity of column 10. It will be appreciated that fabricating column 10 in the manner described above results in a very rigid, strong structure which is capable of carrying significantly larger loads than could be withstood by a column of the same cross-sectional area composed of a single, solid wooden member. This is especially important in situations in which a frame structure is required to carry substantially the entire weight of a building with very little of the structural weight carried by the building walls.

Figure 8:
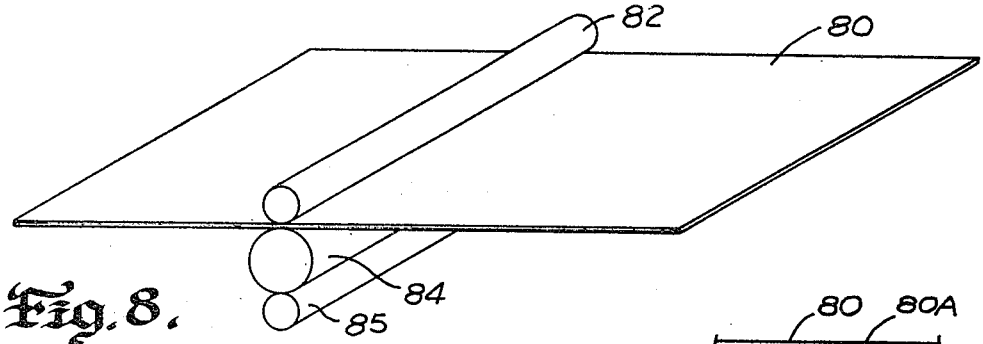
FIG. 8 is a schematic view illustrating the process of coating laminate layers with adhesive material.
Figure 8A:
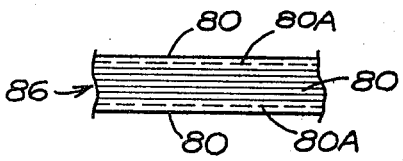
FIG. 8A is a fragmentary, schematic, elevational view of a stack of veneers.
Figure 9:
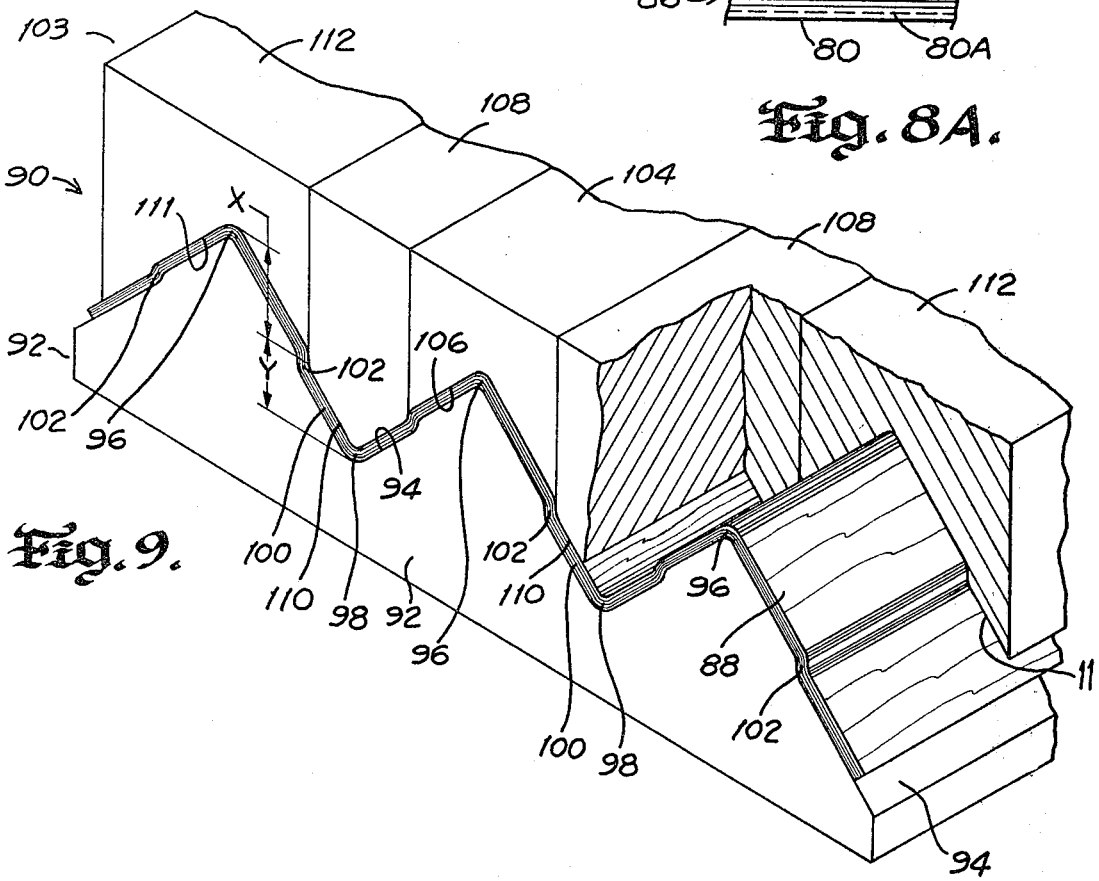
FIG. 9 is a fragmentary, schematic, isometric view, with portions broken away illustrating the procedure of molding a stack of veneers into a formed laminate.
Figure 10:
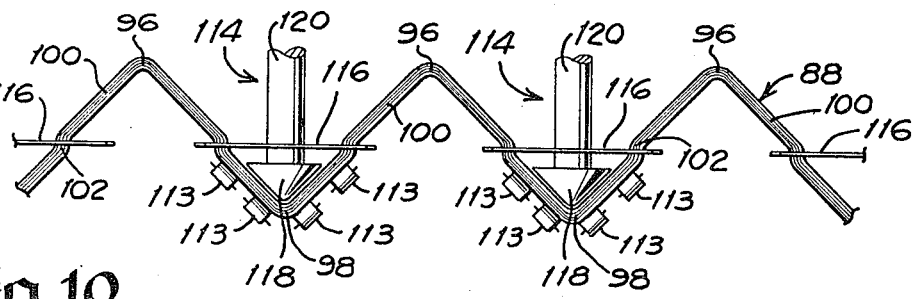
FIG. 10 is a schematic elevational view illustrating the step of cutting the formed laminate into individual angle-shaped members.

A preferred method of constructing column 10 is illustrated in FIGS. 8 through 10, wherein very thin sheets of wooden veneer 80 are coated with a suitable adhesive, such as phenolaldehyde resin, by passing the sheets 80 between an upper drive roller 82 and a lower coating roller 84 driven by a lower drive roller 85, FIG. 8. Thereafter, as shown in FIG. 8A, a plurality of veneers 80 are stacked on top of each other to build up a thickness or stack 86 of, for example, ten sheets each approximately 1.0 millimeter thick to form a thickness 86 of approximately 10.0 millimeters to thereby enable the column 10 to carry relatively large vertical compressive loads. Ideally a majority of the veneer layers 80 are orientated relative to each other so that the direction of their grains are parallel to each other. However, to enable column 10 to also carry loads acting transversely to the length of the column, preferably the next to top veneer layer 80A and the next to the bottom veneer layer 80A are orientated so that the direction of their grains is disposed transversely to the direction of the grains of the rest of the veneer layers 80.

After the veneer layers 80 have been stacked on top of each other in the manner described above, the stack 86 of veneers 80 is formed into a triangularly, wave shaped laminate 88 within a mold 90 shown in FIG. 9. Mold 90 includes a lower half or member 92 having an upper surface 94 contoured in the shape of a triangular wave pattern having crests corresponding to the crest 96 of laminate 88 alternating with valleys corresponding to the valleys 98 of laminate 88. The crests and valleys of mold lower half 92 are interconnected by diagonal legs corresponding to the diagonal legs 100 of laminate 88. Each diagonal leg 100 of laminate 88 includes a very short offset portion 102 formed by moulding the leg with a double bend at a location closer to a valley 98 than a crest 96. Accordingly, offset portion 102 is a distance X below crest 96, which is greater than the distance Y which offset portion 102 is above valley 98. As discussed below, by forming offset portion 102 at this location along diagonal legs 100, the angle-shaped halves 20 of outer layer 16 are formed from the crest portions 96 of formed laminate 88 while the angle-shaped halves 30 of inner layer 18 are formed from the valley portions 98 of the formed laminate.

The upper half of mold 90 is composed of a plurality of individual components extending along the length of crests 96 and valleys 98. As best shown in FIG. 9, the mold upper half components include a central, first section 104 which has a lower surface 106 contoured to correspond to the contour of the central crest portion 96 of laminate 88. The width of mold first section 104 corresponds to the width separating the adjacent offset portions 102 of the central crest portion 96 of laminate 88. Mold first section 104 is powered for up and down movement relative to mold lower half 92.

The upper half 103 of mold 90 also includes a pair of second or intermediate mold sections 108 which are positioned along each side of first section 104 and are powered for up and down movement relative to lower mold half 92 by well-known ram means, not shown. The lower surfaces 110 of mold sections 108 are contoured to correspond to the contour of the valley portions 98 of laminate 88. The width of mold sections 108 corresponds to the horizontal distance separating offset portions 102 of valley portions 98.

Upper mold half 103 further includes a pair of outer or third mold sections 112, one located outwardly adjacent each intermediate mold section 108, as shown in FIG. 9. As with central and intermediate mold sections 104 and 108, respectively, outer mold sections 112 are powered for up and down movement by well-known hydraulic rams, or other conventional power sources, not shown. Each outer mold section 112 has a lower surface 111 which is contoured to correspond to the contour of outer crests 96 of formed laminate 88, and thus also matches the contour of the lower surface 106 of first mold section 104. The outer mold sections 112 form the outside portions of upper mold half 103 and thus are somewhat wider than the width of central mold sections 104 because they extend beyond the outermost offset portions 102 of formed laminate 88 to ensure that such offset portions and their corresponding diagonal leg is correctly formed.

Veneer stack 86 is molded into formed laminate 88 by sandwiching stack 86 between upper and lower mold halves 103 and 92 under pressure and heat. The molding process is accomplished by first placing veneer stack 86 over load mold half 92 and then driving upper mold central section 104 downwardly into engagement with the correspondingly shaped central portion of lower mold half 92 to thereby form the central crest portion 96 of laminate 88, as shown in FIG. 9. Next, the two intermediate mold sections 108 are pressed downwardly into engagement with corresponding portions of lower mold half 92 to form the valley portions 98 of laminate 88. Thereafter, outer mold sections 112 are forced downwardly to engage with corresponding portions of mold lower half 92 to form the outer crest portions 96, shown in FIG. 9. Closing mold 90 by pressing the components of upper mold half 103 downwardly in the sequence described above, from the center of formed laminate 88 outwardly, reduces the possibility that cracks will be induced in veneer stack 86 or that the stack will accidentally slip or shift during closure of mold 90.

Under one typical hot-molding process, upper mold half 103 is forced downwardly into engagement with lower mold half 92 with sufficient force to impart a pressure of 7.5 to 10.0 kilograms per square centimeter on stack 86. This pressure is maintained for approximately ten minutes. Also during the molding process, the stack 88 is heated to a temperature of approximately 140° C. Applying this level of force at this particular temperature for this length of time insures that the adhesive applied to veneer layers 80 is fully cured and also insures that the triangularly shaped wave pattern of FIGS. 9 and 10 is permanently imposed on laminate 88.

After the adhesive has been cured and laminate 88 formed, the components 104, 108 and 112 of upper mold half 103 are retracted upwardly so that formed laminate 88 can be moved from mold 90. Thereafter, the crest and valley portions 96 and 98, respectively, of the laminate are severed from each other to leave angle-shaped outer members 20 and inner members 30, respectively. As shown in FIG. 10, this is accomplished by rolling formed laminate 88 over guide rollers 113 so that the rollers support the underside of valley portions 98. Formed laminate 88 is cut into angle members 20 and 30 by powered saws 114 having horizontally disposed, circular saw blades 116 which are positioned at an elevation corresponding to the middle of offset bend portions 102. Each saw 114 also includes a conically shaped tip portion 118 formed in a profile corresponding to the contour of the upper surface of valley portions 98, FIG. 10. Saw tips 118 serve to vertically restrain laminate 88 while it is being sawn by blades 116 to ensure that accurate cuts are made.

It is to be appreciated that mold 90 can be formed wider, or even narrower than the configuration shown in FIG. 9, to thereby accommodate the width of available veneers 80. Moreover, mold 90 can be utilized in conjunction with veneers narrower than those shown in FIG. 9 by simply not using all of the components of upper mold half 103.

To actually cut formed laminate 88 into angle members 20 and 30, the valley portions 98 of the laminate are advanced through the close fitting gap defined by guide rollers 113 and saw conical tip 118. This can be achieved by powering some or all of the rollers 113 or by alternatively utilizing a well-known feed mechanism, not shown. The rotating saw blades 116, powered by a revolving shaft 120, cut through the centers of offset bend portions 102 so that crest portions 96 form angle members 20 with longitudinal marginal portions 22 in the form of rounded shoulders. The rounded shoulders terminate at edges 23 disposed diagonally to the plane of its adjacent angle member leg. Additionally, once separated from crest portions 96, valley portions 98 form angle members 30 with longitudinal marginal portions 31 in the form of rounded shoulders. The rounded shoulders terminate at edges 32 disposed diagonally to the plane of their adjacent angle member leg.

Columns 10 are formed by first coating diagonal edges 32 of angle members 30 with a suitable adhesive, such as phenolaldehyde resin having a viscosity of about 1500 centipoise, and then assembling the angle members so that their edges 32 are in face-to-face contact with each other. The angle members 30 are held together ideally under a pressure of from 7.5 to 10.0 kilograms per square member and the temperature of 140° C. for approximately ten minutes to cure the adhesive so that a integral, hollow, square-shaped inner layer 18 is formed, as shown in FIG. 3. The same process is followed to form outer layer 16 from angle members 20; however, with the exception that angle members 20 are placed over inner layer 18 before they are pressed together under heat and pressure. Ideally, outer angle members 20 are oriented relative to inner angle members 30 so that their edges 23 are diagonally opposed to the edges 32 of inner layer 18 to thereby enhance the structural integrity of column 10.

As evident from FIGS. 2 and 3, column 10 is formed with uniform rounded corners giving the appearance of a solid column of wood with no exposed edges which detract from the appearance of the column. Also, it can be appreciated that by the above procedure, a plurality of angle members 20 and 30 can be efficiently formed in a single operation thereby minimizing the manufacturing costs of columns 10.

In one specific example of a column constructed according to the preferred method described above, inner layes 18 and outer layers 16 are constructed from wooden laminations, each approximately 1.0 millimeter (mm) thick, with a total thickness of each layer of approximately 10.0 mm. Further, ideally column 10 is square in cross section with an outside width of approximately 100.0 mm thereby resulting in a width of approximately 80.0 mm for inner layer 18. Applicant has found that constructing column 10 with these particular dimensions gives it sufficient strength to be extensively used in the type of residential housing construction wherein most of the weight of the structure is carried by columns rather than by exterior and interior walls. It is to be understood, however, that columns 10 can be constructed in other sizes and the laminations composing inner layer 18 and outer layer 16 can be of other thicknesses, for instance, to fabricate columns with varying load carrying capacities and to accommodate the specific types of wood used to form layers 16 and 18, since not all types of wood exhibit the same structural strength.

FIGS. 1 and 2 illustrate one typical manner in which columns 10 can be used to form part of the framework 12 of building structure 14. As most clearly illustrated in FIG. 2, the hollow plug portion 38 of a joiner insert 40 is first engaged into the hollow interior of innter layer 18 until the flange portion 42 of the joiner insert abuts against the end of column 10. Columns 10 are longitudinally interconnected together by hollow, square-shaped, connector blocks 44, which have a central opening 46 at each end for slidably receiving the stud portion 48 of joiner insert 40, which stud extends transvesely from flange portion 42 in the direction opposite to plug portion 38. Columns 10 are interconnected with horizontal beams 50 through the use of T-shaped brackets 52, each of which engages within a slot 54 formed in the end portion of each beam 50. Brackets 52 are secured to the ends of beams by capscrew 55 which extends through aligned, transverse openings formed in beam 50 and bracket 52 to engage with a nut 56. Each bracket 52 includes a plurality of vertically spaced hooks 57 that slidably engage within correspondingly spaced openings 58 provided centrally along the height of each of the four side walls of block 44.

It will be appreciated that because columns 10 are formed of laminations of very thin, narrow strips of wood, rather than from thickner, singular pieces, almost all of the wood in a log can be utilized to form column 10. As a result, very little waste occurs and our precious natural resources are efficiently utilized. Furthermore, since column 10 is formed from laminated wooden material, it is decorative enough to be left exposed to either the exterior or interior of a building or dwelling. Thus, no additional expense need be incurred to encase column 10 within a cosmetic outer shell or to overlay column 10 with additional finish materials.

Figure 4:
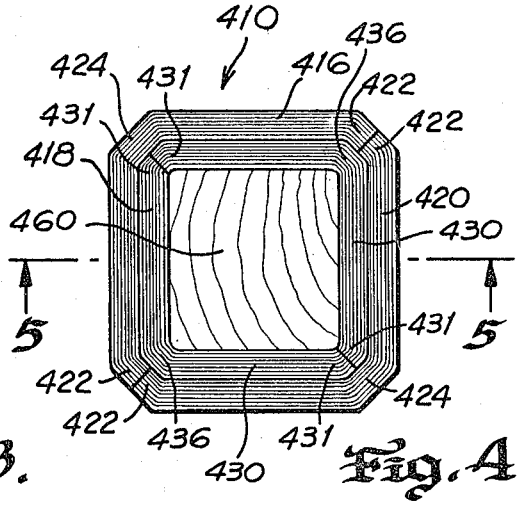
FIG. 4 is a greatly enlarged, transverse, cross-sectional view, similar to FIG. 3, of another typical embodiment of the present invention wherein the corners of the column are beveled and the interior of the column is occupied by a central, one-piece core.
Figure 5:
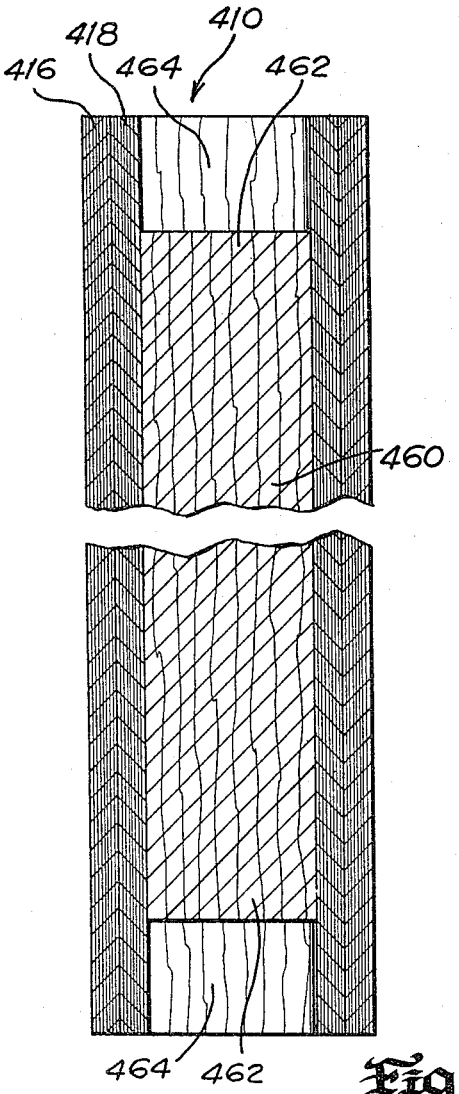
FIG. 5 is a greatly enlarged, transverse, cross-sectional view of the typical embodiment of the present invention illustrated in FIG. 4 and taken substantially along lines 5—5 thereof.
Figure 13:
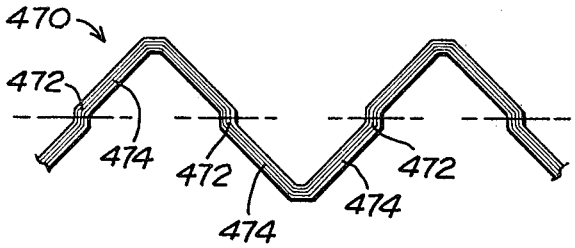
FIG. 13 is another alternative embodiment of a formed laminate of the present invention corresponding to the column shown in FIG. 4 having beveled corners.

FIGS. 4 and 5 illustrate an alternative typical embodiment of the present invention wherein outer layer 416 and inner layer 418 are formed with beveled corners, rather than rounded in the manner of outer layer 16 and inner layer 18 of column 10 shown in FIG. 3. As shown in FIG. 13, when laminate 470 is formed, the offset bend portions 472 are disposed vertically, while the leg portions 474 are ideally at an angular orientation 45° to the vertical disposition of offset portion 472. Thus, cutting through the mid-points of offset portions 472 of formed laminate 470 by a saw, not shown, such as saw 114 shown in FIG. 10, creates outer angle members 420 having marginal shoulders 422 disposed at 45° relative to their corresponding planar surface, and inner angle members 430 having marginal shoulders 431 diagonally disposed at 45° relative to their corresponding planar surfaces. Thereby, when two outer members 420 are assembled together, their marginal shoulder portions 422 form a continuous, beveled corner identical to corner 424, and when two inner members 430 are assembled together, their marginal shoulder portions 431 form a continuous, beveled corner corresponding to corner 436. With the exception of the different configuration of their corners, inner layer 418 and outer layer 416 are shaped and manufactured essentially identically to column 10 shown in FIGS. 1–3.

Another difference between the column 410 shown in FIGS. 4 and 5 and the column 10 shown in FIGS. 2 and 3, is that a core member 460 is snugly disposed within the hollow interior of inner layer 418 to thereby increase the cross-sectional area and the section modulus of column 410, and thus the load carrying capacity of the column. Core member 460 is constructed from a singular, nonlaminated piece of wood material which is generally square in cross-section and securely bonded to the inside wall of inner layer 418 with a suitable adhesive, such as phenolaldehyde resin. To maximize the strength of column 410, preferably the direction of the grain of core member 460 extends along the length of column 410. As best illustrated in FIG. 5, core member 460 preferably is somewhat shorter than the length of column 410 so that each end 462 of the core is recessed within inner layer 418 to form a longitudinal socket 464 within each end portion of the column to receive the plug portion of a joiner insert, such as plug portion 38 of joiner insert 40 illustrated in FIG. 2 and described above.

It is to be appreciated that if joiner insert 40 is used to assemble columns 410, the joiner insert can be constructed differently than described above, such as by replacing plug portion 38 with a stud portion similar to stud portion 48. Correspondingly, core member 460 extends the full length of column 410 and each end portion of the core member is provided with a blind hole, not shown, for receiving the stud portion of the modified form of joiner insert. Other than the addition of core member 460 and the beveled corners of inner layer 418 and outer layer 416, column 410 is constructed, and preferably manufactured, identically with column 10 previously described and illustrated in FIGS. 1–3.

Figure 6:
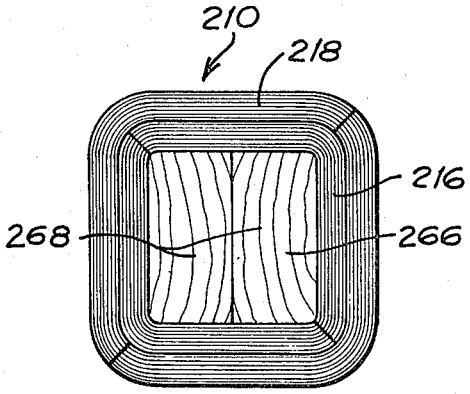
FIGS. 6 and 7 are greatly enlarged, cross-sectional views, similar to FIG. 3, of alternative embodiments of the present invention involving different central core constructions.

In another typical embodiment of the present invention illustrated in FIG. 6, a column 210 is constructed similarly to column 10 described above, wherein the hollow interior of inner layer 216 is occupied by a core member 266 composed of two lengths 268 of solid wooden material glued, or otherwise bonded together, to form a unitary structure, which in turn is bonded to the inside surface of inner layer 216. As with core 460, shown in FIGS. 4 and 5, the ends of core members 268 are preferably recessed within the ends of column 210 to form a socket, not shown, in each end thereof. Also, ideally the grains of wooden components 268 extend longitudinally of the length of core member 266 to thereby maximize the strength of the core member.

Figure 7:
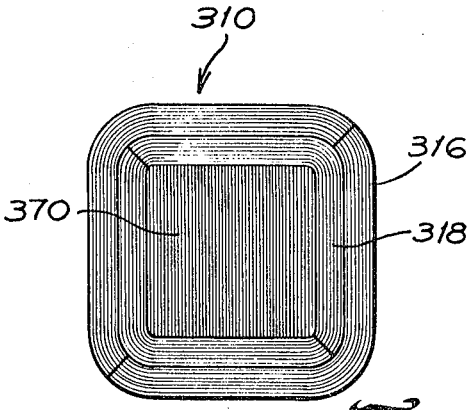

One further alternative typical embodiment of the present invention is depicted in FIG. 7 wherein column 310 includes a core member 370 composed of very thin strips of wood veneer laminated together to form a unitary structure in a manner analogous to the construction of outer layers 316 and inner layer 318. Preferably the ends of core member 370 are also recessed within the ends of column 310 to form a longitudinal socket, not shown, within each end of the column. However, as with column 410, described above, if plug portion 38 of joiner insert 40 is replaced with a stud, core member 370 will extend the entire length of column 310 and a blind hold for receiving the stud will be provided in each end portion of the core member. Furthermore, except for the addition of core member 370, column 310 preferably is constructed similarly to the construction of column 10, described above and illustrated in FIGS. 1–3.

Figure 11:
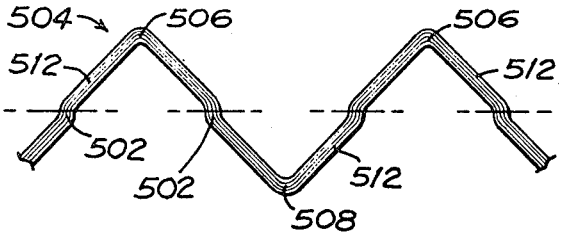
FIG. 11 is a schematic, fragmentary elevational view illustrating an alternative formed laminate embodiment wherein the offset portion of each diagonal leg is located at the vertical center of the formed laminate.
Figure 12:
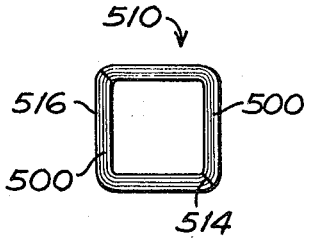
FIG. 12 is a fragmentary isometric view showing a column assembled from the angle-shaped members shown in FIG. 11.

FIG. 11 illustrates an alternative process wherein a plurality of angle members 500 of a single layered column, such as column 510 shown in FIG. 12, can be produced at the same time. This process is essentially identical to the procedure for forming the components of the column 10, described above, with the exception that the offset bend portions 502 of formed laminate 504 are located halfway between crests 506 and valleys 508, which location corresponds to the mid-length of each leg 512. Thus, when formed laminate 504 is cut by a saw, not shown, in the manner similar to saw 90 shown in FIG. 10, the crest portions 506 and the valley portions 508 of the laminate form substantially identical angle members.

To assemble the beam 510 shown in FIG. 12, the angle shaped members 500 are bonded together under pressure and heat after their diagonally disposed edges 514 have been coated with a suitable adhesive in the manner described above to thereby form a hollow, square-shaped form. From FIG. 12, it can be seen that by the above-described manufacturing method, column 510 is formed with uniform rounded corners giving the appearance of a solid column of wood having no exposed edges which detract from the appearance of the column.

The present invention may be embodied in specific forms other than the typical examples of the columns described above and embodied in methods of manufacturing the columns other than the methods described above without departing from the spirit or essential characteristics thereof. The embodiments of, and the methods of forming, the columns illustrated and discussed above are therefore to be considered in all respects as simply illustrative and not restrictive. The scope of the present invention is as set forth in the appended claims rather than being limited to the typical examples described in the foregoing description.

We claim:

1. A method of forming a structural column comprising the steps of:

coating very thin layers of wood veneers with an adhesive;

placing a plurality of veneer layers on top of each other to form a stack of veneer layers;

forming the stack of veneer layers into a triangularly shaped wave pattern laminate having alternating crest and valley portions interconnected by diagonal legs, each leg having an offset bend located at an elevation below the longitudinal mid point of the leg, cutting the formed veneer along a horizontal line extending through the offset bend portion of each diagonal leg to form outer angle-shaped components having formed marginal shoulders, and inner angle-shaped components having formed marginal shoulders;

bonding a pair of inner angle-shaped components together along their formed marginal shoulders to form a hollow inner member having a closed cross section and no exposed edges;

placing a pair of outer angle shaped components over the assembled inner member; and bonding the outer angle shaped components together and to the outer surface of the inner member to form a unitary, hollow structural column.

2. A method of forming a structural column according to claim 1, wherein the step of placing a plurality of veneer layers on top of each other includes orientating all of the layers relative to each other so that their grains are aligned parallel to each other except the next to the top layer and the next to the bottom layer, which two layers are orientated so that their grains extend transversely to the length of the grains of the remaining layers.

3. A method of producing a structural column according to claim 1, wherein the step of placing a pair of outer angle shaped components over the assembled inner members includes positioning the outer angle-shaped components relative to the inner angle-shaped components so that the marginal shoulders of the outer angle-shaped components are diagonally opposed to the location of the marginal edges of the inner angle-shaped components.

4. A method of producing a structrucal column according to claim 1, wherein the step of bonding a pair of inner angle-shaped components together includes placing the inner angle-shaped components over a longitudinally extending central core member and bonding the pair of angle-shaped components so the core member at the same time the marginal shoulders of the pair of angle-shaped components themselves are bonded together.

5. A method of forming a structural column according to claim 1, wherein the step of forming the layers of veneers into a triangularly shaped wave pattern includes:

(a) placing the stack of veneer layers on the lower half of a mold having an upper surface contoured generally in the shape of a triangularly shaped wave pattern including alternating crest and valley portions interconnected by diagonal legs, which legs have an offset bend centrally located along each of their lengths, (b) closing the mold by forcing an upper mold half assembly composed of a plurality of individual mold components downwardly against the stack of veneer layers under pressure and heat to form the veneer layers into a wave-shaped pattern and to cure the adhesive, each component of said upper mold half assembly:

(1) having a width corresponding to the width of a crest or valley portion of the lower mold half, (2) extending longitudinally along the crest and valley portions of the lower mold half, and (3) shaped corresponding to the lower mold half; and (c) removing the formed veneer from the upper and lower mold halves.

6. A method of forming a structural column according to claim 5, wherein the step of closing the mold further includes first forcing a centrally located upper mold half component down into engagement with the lower mold half and then sequentially forcing pairs of upper mold half components down into engagement with the lower mold half starting with the pair of components adjacent each side of the central upper mold half component and then the next outwardly located pair of upper mold half components until all of the upper mold half components have been engaged with corresponding portions of the lower mold half.

7. A method for forming a structural column which comprises:

coating very thin layers of wooden veneers with an adhesive;

placing a plurality of veneer layers on top of each other;

molding the stack of veneer layers into a triangularly shaped wave pattern having alternating crest and valley portions interconnected by diagonal legs, with each leg having an offset bend centrally located along its length;

slicing the molded wooded veneers along their offset bend portions to form angle-shaped members having formed marginal shoulders; and bonding two angle-shaped components together along their formed marginal shoulders to form a closed hollow structural column having no exposed edges.

8. A method of forming a structural column according to claim 7, wherein the step of placing a plurality of veneer layers on top of each other includes orientating all of the layers relative to each other so that their grains are aligned parallel to each other except the next to the top layer and the next to the bottom layer, which two layers are oriented so that their grains extend transversely to the length of the grains of the remaining layers.

9. A method of producing a structural column according to claim 7, wherein the step of bonding two angle-shaped components together includes placing the components over a longitudinally extending central core member and bonding the two components to the central core member at the same time the formed marginal shoulders of the two components themselves are bonded together.

10. A method of forming a structural column according to claim 7, wherein the step of molding the layers of veneers into a triangularly shaped wave pattern includes:

placing the stack of veneer layers on the lower half of a mold having an upper surface contoured generally in the shape of a triangularly shaped wave pattern with alternating crest and valley portions interconnected by diagonal legs having an offset bend centrally located along the length of each leg of the wave pattern;

closing the mold by forcing an upper mold half assembly composed of a plurality of individual components:

having a width corresponding to the width of a crest or valley portion of the lower mold half, extending longitudinally along the crest and valley portions of the lower mold half, and shaped corresponding to the lower mold half, downwardly against the stack of veneer layers under pressure and heat to form the veneer layers into a wave-shaped pattern and to cure the adhesive; and removing the formed veneer from the upper and lower mold halves.

11. A method of forming a structural column according to claim 10, wherein the step of closing the mold further includes first forcing a centrally located upper mold half component down into engagement with the lower mold half and then sequentially forcing pairs of upper mold half components down into engagement with the lower mold half starting with the pair adjacent each side of the central upper mold half component and then the next outwardly located pair of upper mold half components until all of the upper mold half components have been engaged with corresponding portions of the lower mold half.

* * * * *